US012082623B2

(12) United States Patent
Lomas et al.

(10) Patent No.: US 12,082,623 B2
(45) Date of Patent: Sep. 10, 2024

(54) SMOKING SUBSTITUTE DEVICE

(71) Applicant: Imperial Tobacco Limited

(72) Inventors: Pete Lomas, Liverpool (GB); Chris Lord, Liverpool (GB); Edward Ross Shenton, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 899 days.

(21) Appl. No.: 17/086,717

(22) Filed: Nov. 2, 2020

(65) Prior Publication Data

US 2021/0127752 A1 May 6, 2021

Related U.S. Application Data

(63) Continuation of application No. PCT/EP2019/061160, filed on May 1, 2019, and a continuation of application No. PCT/EP2019/061150, filed on May 1, 2019.

(30) Foreign Application Priority Data

May 1, 2018 (GB) ..... 1807156
May 1, 2018 (GB) ..... 1807159

(51) Int. Cl.
*A24F 40/90* (2020.01)
*A24F 40/40* (2020.01)

(52) U.S. Cl.
CPC ..... *A24F 40/90* (2020.01); *A24F 40/40* (2020.01)

(58) Field of Classification Search
CPC ..... A24F 40/40; A24F 40/90; A24F 47/00
See application file for complete search history.

(56) References Cited

U.S. PATENT DOCUMENTS

2014/0283858 A1 9/2014 Liu
2014/0355969 A1 12/2014 Stern
2015/0335073 A1 11/2015 Li et al.
2019/0046745 A1* 2/2019 Nettenstrom et al. ..... A61M 15/06

FOREIGN PATENT DOCUMENTS

CN 203168030 U 9/2013
CN 203762297 U 8/2014
CN 204483018 U 7/2015
(Continued)

OTHER PUBLICATIONS

UK Intellectual Property Office; Combined Search and Examination Report in GB1807156.3, filed May 1, 2018, dated Oct. 25, 2018.
(Continued)

*Primary Examiner* — Christopher M Rodd
*Assistant Examiner* — Ronnie Kirby Jordan
(74) *Attorney, Agent, or Firm* — DUNLAP CODDING, P.C.

(57) ABSTRACT

A smoking substitute device. The device comprising: a battery; and a connector, usable to connect a consumable to the battery. Wherein the connector includes one or more electrical connectors, for connecting a heater in the consumable to the battery, and one or more physical connectors configured to releasably retain the consumable. The connector further comprises a flexible seal, disposed between the battery and the consumable when the consumable is retained by the connector.

15 Claims, 3 Drawing Sheets

(56) References Cited

FOREIGN PATENT DOCUMENTS

| | | | |
|---|---|---|---|
| CN | 206866632 | U | 1/2018 |
| EP | 3183981 | A1 | 6/2017 |
| GB | 2548647 | A | 9/2017 |
| WO | WO2014144678 | A2 | 9/2014 |
| WO | WO2018018369 | A1 | 2/2018 |

OTHER PUBLICATIONS

UK Intellectual Property Office; Combined Search and Examination Report in GB1807159.7, filed May 1, 2018, dated Sep. 25, 2018.
International Search Report, mailed Jul. 31, 2019, in PCT/EP2019/061150, filed May 1, 2018.
Written Opinion of the International Searching Authority, mailed Jul. 31, 2019, in PCT/EP2019/061150, filed May 1, 2018.
International Search Report, mailed Jul. 31, 2019, in PCT/EP2019/061160, filed May 1, 2018.
Written Opinion of the International Searching Authority, mailed Jul. 31, 2019, in PCT/EP2019/061160, filed May 1, 2018.

* cited by examiner

SMOKING SUBSTITUTE DEVICE

CROSS-REFERENCE TO RELATED APPLICATIONS/INCORPORATION BY REFERENCE STATEMENT

The present patent application is a continuation of International Application No. PCT/EP2019/061150, filed May 1, 2019; which claims priority to the patent application identified by GB Serial No. 1807156.3, filed on May 1, 2018. The present patent application is also a continuation of International Application No. PCT/EP2019/061160, filed May 1, 2019; which claims priority to the patent application identified by GB Serial No. 1807159.7, filed on May 1, 2018. The entire contents of each of the above-referenced patent(s)/patent application(s) are hereby expressly incorporated by reference herein.

FIELD OF THE INVENTION

The present invention relates to smoking substitute devices, and particularly, although not exclusively, to providing smoking substitute devices with flexible seals located at a connection between a main body of the smoking substitute device and a consumable.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute devices in order to avoid the smoking of tobacco.

Such smoking substitute devices can form part of nicotine replacement therapies aimed at people who wish to stop smoking and overcome a dependence on nicotine.

Smoking substitute devices, which may also be known as electronic nicotine delivery systems, may comprise electronic systems that permit a user to simulate the act of smoking by producing an aerosol, also referred to as a "vapour", which is drawn into the lungs through the mouth (inhaled) and then exhaled. The inhaled aerosol typically bears nicotine and/or flavourings without, or with fewer of, the odour and health risks associated with traditional smoking.

In general, smoking substitute devices are intended to provide a substitute for the rituals of smoking, whilst providing the user with a similar experience and satisfaction to those experienced with traditional smoking and tobacco products.

The popularity and use of smoking substitute devices has grown rapidly in the past few years. Although originally marketed as an aid to assist habitual smokers wishing to quit tobacco smoking, consumers are increasingly viewing smoking substitute devices as desirable lifestyle accessories. Some smoking substitute devices are designed to resemble a traditional cigarette and are cylindrical in form with a mouthpiece at one end. Other smoking substitute devices do not generally resemble a cigarette (for example, the smoking substitute device may have a generally box-like form).

There are a number of different categories of smoking substitute devices, each utilising a different smoking substitute approach. A smoking substitute approach corresponds to the manner in which the substitute system ope rates for a user.

One approach for a smoking substitute device is the so-called "vaping" approach, in which a vapourisable liquid, typically referred to (and referred to herein) as "e-liquid", is heated by a heating device to produce an aerosol vapour which is inhaled by a user. An e-liquid typically includes a base liquid as well as nicotine and/or flavourings. The resulting vapour therefore typically contains nicotine and/or flavourings. The base liquid may include propylene glycol and/or vegetable glycerin.

A typical vaping smoking substitute device includes a mouthpiece, a power source (typically a battery), a tank for containing e-liquid, as well as a heating device. In use, electrical energy is supplied from the power source to the heating device, which heats the e-liquid to produce an aerosol (or "vapour") which is inhaled by a user through the mouthpiece.

Vaping smoking substitute devices can be configured in a variety of ways. For example, there are "closed system" vaping smoking substitute devices which typically have a sealed tank and heating element which is pre-filled with e-liquid and is not intended to be refilled by an end user. One subset of closed system vaping smoking substitute devices include a main body which includes the power source, wherein the main body is configured to be physically and electrically coupled to a consumable including the tank and the heating element. In this way, when the tank of a consumable has been emptied, the main body can be reused by connecting it to a new consumable. Another subset of closed system vaping smoking substitute devices are completely disposable, and intended for one-use only.

There are also "open system" vaping smoking substitute devices which typically have a tank that is configured to be refilled by a user, so the device can be used multiple times.

An example vaping smoking substitute device is the myblu™ e-cigarette. The myblu™ e-cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heating device, which for this device is a heating filament coiled around a portion of a wick which is partially immersed in the e-liquid. The device is activated when a microprocessor on board the main body detects a user inhaling through the mouthpiece. When the device is activated, electrical energy is supplied from the power source to the heating device, which heats e-liquid from the tank to produce a vapour which is inhaled by a user through the mouthpiece.

Another example vaping smoking substitute device is the blu PROT™ e-cigarette. The blu PROT™ e-cigarette is an open system device which includes a main body, a (refillable) tank, and a mouthpiece. The main body and tank are physically and electrically coupled together by screwing one to the other. The mouthpiece and refillable tank are physically coupled together by screwing one into the other, and detaching the mouthpiece from the refillable tank allows the tank to be refilled with e-liquid. The device is activated by a button on the main body. When the device is activated, electrical energy is supplied from the power source to a heating device, which heats e-liquid from the tank to produce a vapour which is inhaled by a user through the mouthpiece.

Another approach for a smoking substitute device is the so-called "heat not burn" ("HNB") approach in which tobacco (rather than e-liquid) is heated or warmed to release vapour. The tobacco may be leaf tobacco or reconstituted tobacco. The vapour may contain nicotine and/or flavourings. In the HNB approach the intention is that the tobacco is heated but not burned, i.e. does not undergo combustion.

A typical HNB smoking substitute device may include a main body and a consumable. The consumable may include the tobacco material. The main body and consumable may be configured to be physically coupled together. In use, heat may be imparted to the tobacco material by a heating device that is typically located in the main body, wherein airflow through the tobacco material causes moisture in the tobacco material to be released as vapour. A vapour may be formed from a carrier in the tobacco material (this carrier may for example include propylene glycol and/or vegetable glycerin) and additionally volatile compounds released from the tobacco. The released vapour may be entrained in the airflow drawn through the tobacco.

As the vapour passes through the smoking substitute device (entrained in the airflow) from an inlet to a mouthpiece (outlet), the vapour cools and condenses to form an aerosol (also referred to as a vapour) for inhalation by the user. The aerosol will normally contain the volatile compounds.

In HNB smoking substitute devices, heating as opposed to burning the tobacco material is believed to cause fewer, or smaller quantities, of the more harmful compounds ordinarily produced during smoking. Consequently, the HNB approach may reduce the odour and/or health risks that can arise through the burning, combustion and pyrolytic degradation of tobacco.

An example of the HNB approach is the IQOS® smoking substitute device from Philip Morris Ltd. The IQOS® smoking substitute device uses a consumable, including reconstituted tobacco located in a wrapper. The consumable includes a holder incorporating a mouthpiece. The consumable may be inserted into a main body that includes a heating device. The heating device has a thermally conductive heating knife which penetrates the reconstituted tobacco of the consumable, when the consumable is inserted into the heating device. Activation of the heating device heats the heating element (in this case a heating knife), which, in turn, heats the tobacco in the consumable. The heating of the tobacco causes it to release nicotine vapour and flavourings which may be drawn through the mouthpiece by the user through inhalation.

A second example of the HNB approach is the device known as "Glo"® from British American Tobacco p.l.c. Glo® comprises a relatively thin consumable. The consumable includes leaf tobacco which is heated by a heating device located in a main body. When the consumable is placed in the main body, the tobacco is surrounded by a heating element of the heating device. Activation of the heating device heats the heating element, which, in turn, heats the tobacco in the consumable. The heating of the tobacco causes it to release nicotine vapour and flavourings which may be drawn through the consumable by the user through inhalation. The tobacco, when heated by the heating device, is configured to produce vapour when heated rather than when burned (as in a smoking apparatus, e.g. a cigarette). The tobacco may contain high levels of aerosol formers (carrier), such as vegetable glycerine ("VG") or propylene glycol ("PG").

The present inventor(s) have observed that inconsistencies in the manufacturing of consumables and devices lead to a variable performance of smoking substitute devices.

The present invention has been devised in light of the above considerations.

SUMMARY

Accordingly, at its broadest aspects of the invention are concerned with a flexible lip seal located between a consumable and a main body of a smoking substitute device.

In a first aspect, the invention provides a smoking substitute device comprising: a battery; and a connector, usable to connect a consumable to the battery; wherein the connector includes one or more electrical connectors, for connecting a heater in the consumable to the battery, and one or more physical connectors configured to releasably retain the consumable; wherein the connector further comprises a flexible seal, disposed between the battery and the consumable when the consumable is retained by the connector, and wherein the flexible seal includes one or more airway slots, such that when a consumable is retained by the connector an airflow path is provided from an air inlet of the device through the one or more airway slots and into the consumable.

In a second aspect, the invention provides a smoking substitute device comprising: a battery; and a connector, usable to connect a consumable to the battery; wherein the connector includes one or more electrical connectors, for connecting a heater in the consumable to the battery, and one or more physical connectors configured to releasably retain the consumable; wherein the connector further comprises a flexible seal, disposed between the battery and the consumable when the consumable is retained by the connector, and wherein the flexible seal comprises a generally planar portion positioned adjacent to the battery, and a protruding portion which protrudes from the planar base portion and which is adjacent to the consumable when the consumable is retained by the connector.

Advantageously, such a flexible connector can ensure that effects due to the variation in the dimensions of the consumable are negated. For example, the flexible seal can ensure that an airflow rate through the device into the consumable is consistent for any given consumable.

Optional features of the invention will now be set out. These are applicable singly or in any combination.

The battery may be provided within a main housing of the device, and the connector may be provided at one end thereof. Alternatively, the battery may be provided within a main housing of the device, and the connector may be formed by one end thereof. In both arrangements, the flexible seal may be provided between the main housing and the connector.

The flexible seal may include an aperture through which electrical connectors of the consumable are connectable with the electrical connectors of the connector when the consumable is retained by the connector.

The flexible seal may be formed of a polymer. More specifically, the flexible seal may be formed of an elastomer. The flexible seal may be resiliently deformable. In some examples, the flexible seal may be formed of silicone.

The flexible seal may form a seal with a lower surface of the consumable when the consumable is retained by the connector, said lower surface including one or more air inlets for the consumable.

The flexible seal may be ovoid in shape.

The flexible seal may comprise a generally planar base portion positioned adjacent to the battery or main housing, and a protruding portion which protrudes from the planar base portion and which is adjacent to the consumable when the consumable is retained by the connector.

The protruding portion may be configured to be compressed towards the planar base portion when the consumable is retained by the connector.

The flexible seal may include one or more airway slots, such that when a consumable is retained by the connector an airflow path is provided from an air inlet of the device through the one or more airway slots and into the consumable.

The one or more airway slots may be provided within the protruding portion of the flexible seal.

The protruding portion may protrude from the planar base portion at an oblique angle, thereby providing a lip seal. By oblique, it may be meant that the protruding portion protrudes from the base portion at an angle not equal to 90°. The protrusion of the protruding portion may be such that it has a component parallel to a surface of the planar base portion.

The protruding portion may have a maximum width, as measured from one point to an opposing point, which is less than a maximum width of the planar base portion. Said another way, the protruding portion may not be as wide as the planar base portion. Therefore, as viewed from above the protruding portion may be entirely contained within a footprint of the planar base portion.

BRIEF DESCRIPTION OF THE DRAWINGS

Embodiments of the invention will now be described by way of example with reference to the accompanying drawings in which:

FIG. 1(*b*) shows the main body of the smoking substitute device of FIG. 1(*a*) without the consumable;

FIG. 1(*c*) shows the consumable of the smoking substitute device of FIG. 1(*a*) without the main body;

FIG. 2(*b*) is a schematic view of the consumable of the smoking substitute device of FIG. 1(*b*);

DETAILED DESCRIPTION AND FURTHER OPTIONAL FEATURES

Aspects and embodiments of the present invention will now be discussed with reference to the accompanying figures. Further aspects and embodiments will be apparent to those skilled in the art.

Figure 1A:
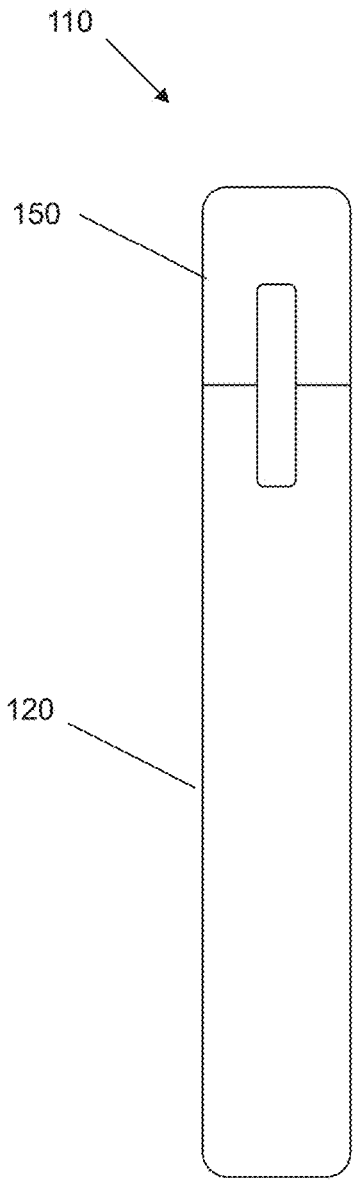
FIG. 1(*a*) shows an example smoking substitute device.
Figure 1B:
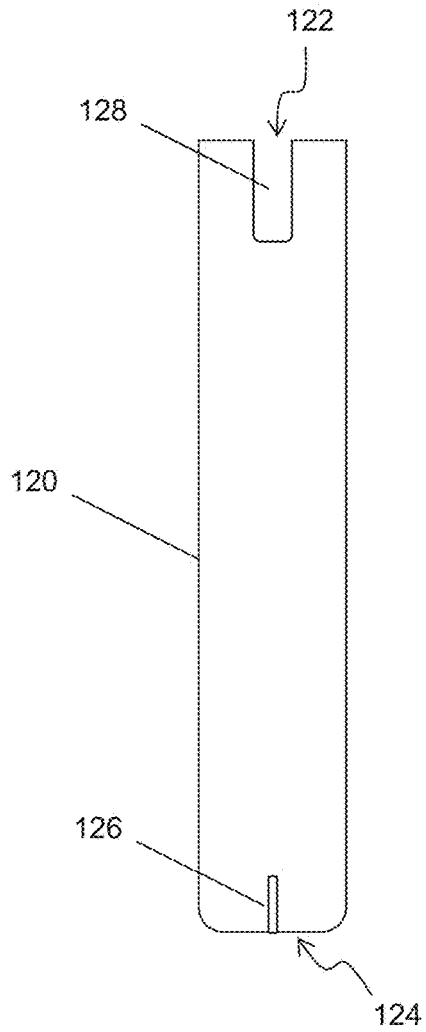
Figure 1C:
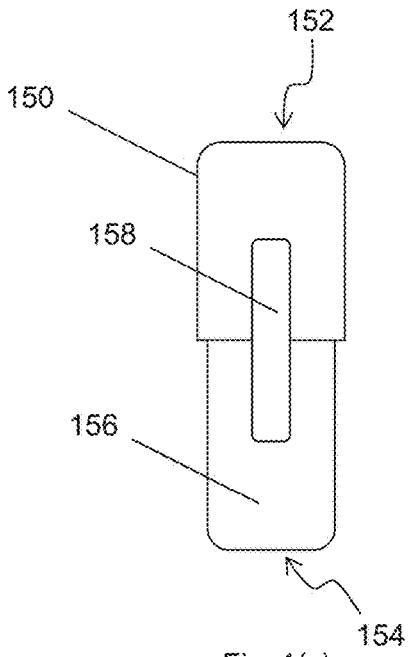

FIG. 1(*a*) shows an example smoking substitute device 110. In this example, the smoking substitute device 110 includes a main body 120 and a consumable 150. The consumable 150 may alternatively be referred to as a "pod".

In this example, the smoking substitute device 110 is a closed system vaping device, wherein the consumable 150 includes a sealed tank 156 and is intended for one-use only.

FIG. 1(*a*) shows the smoking substitute device 110 with the main body 120 physically coupled to the consumable 150.

FIG. 1(*b*) shows the main body 120 of the smoking substitute device 110 without the consumable 150.

FIG. 1(*c*) shows the consumable 150 of the smoking substitute device 110 without the main body 120.

The main body 120 and the consumable 150 are configured to be physically coupled together, in this example by pushing the consumable 150 into an aperture in a top end 122 of the main body 120. In other examples, the main body 120 and the consumable could be physically coupled together by screwing one onto the other, or through a bayonet fitting, for example. An optional light 126, e.g. an LED located behind a small translucent cover, is located a bottom end 124 of the main body 120. The light 126 may be configured to illuminate when the smoking substitute device 110 is activated.

The consumable 150 includes a mouthpiece (not shown) at a top end 152 of the consumable 150, as well as one or more air inlets (not shown in FIG. 2) so that air can be drawn into the smoking substitute device 110 when a user inhales through the mouthpiece. At a bottom end 154 of the consumable 150, there is located a tank 156 that contains e-liquid. The tank 156 may be a translucent body, for example.

The tank 156 preferably includes a window 158, so that the amount of e-liquid in the tank 156 can be visually assessed. The main body 120 includes a slot 128 so that the window 158 of the consumable 150 can be seen whilst the rest of the tank 156 is obscured from view when the consumable 150 is inserted into the aperture in the top end 122 of the main body 120.

The tank 156 may be referred to as a "clearomizer" if it includes a window 158, or a "cartomizer" if it does not.

The consumable 150 may identify itself to the main body 120, via an electrical interface, RFID chip, or barcode.

Figure 2A:
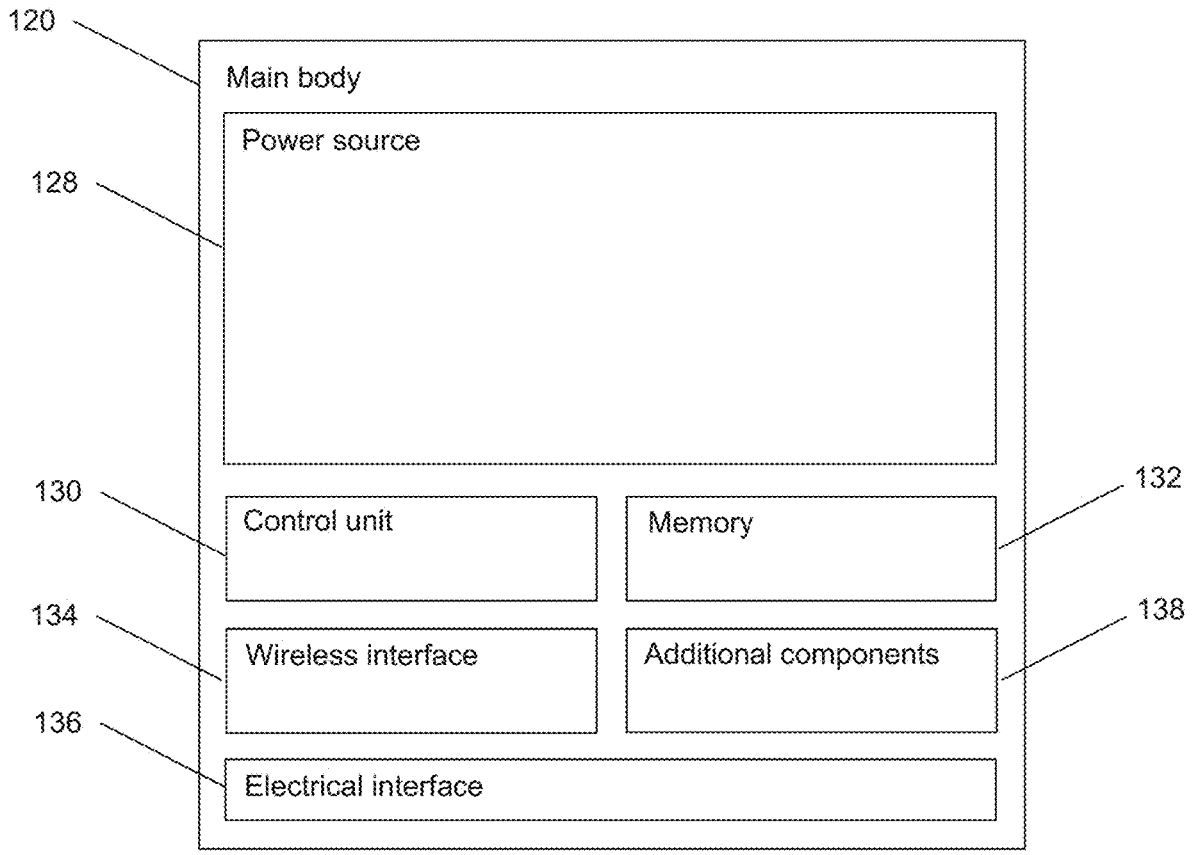
FIG. 2(*a*) is a schematic view of the main body of the smoking substitute device of FIG. 1(*a*)
Figure 2B:
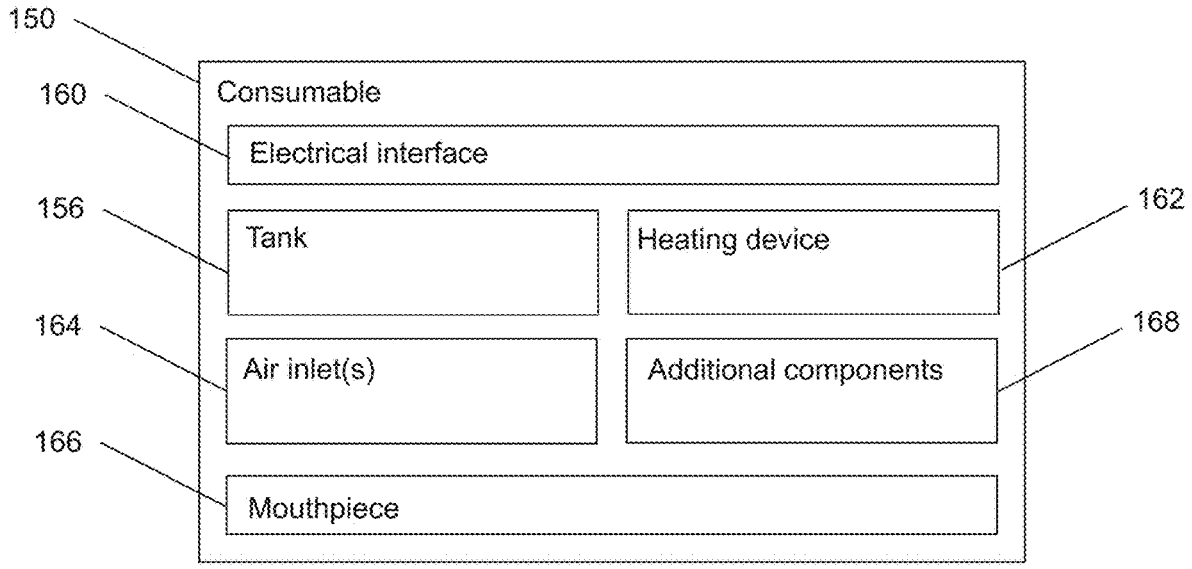

FIG. 2(*a*) is a schematic view of the main body 120 of the smoking substitute device 110.

FIG. 2(*b*) is a schematic view of the consumable 150 of the smoking substitute device 110.

As shown in FIG. 2(*a*), the main body 120 includes a power source 140, a control unit 130, a memory 132, a wireless interface 134, an electrical interface 136, and, optionally, one or more additional components 138.

The power source 140 is preferably a battery, more preferably a rechargeable battery.

The control unit 130 may include a microprocessor, for example.

The memory 132 is preferably includes non-volatile memory. The memory may include instructions which, when implemented, cause the control unit 130 to perform certain tasks or steps of a method.

The wireless interface 134 is preferably configured to communicate wirelessly with the mobile device 2, e.g. via Bluetooth®. To this end, the wireless interface 134 could include a Bluetooth® antenna. Other wireless communication interfaces, e.g. WiFi®, are also possible. As discussed above, the wireless interface 134 may be configured to communicate wirelessly with the remote server 2.

The electrical interface 136 of the main body 120 may include one or more electrical contacts. The electrical interface 136 may be located in, and preferably at the bottom of, the aperture in the top end 122 of the main body 120. When the main body 120 is physically coupled to the consumable 150, the electrical interface 136 may be configured to pass electrical power from the power source 140 to (e.g. a heating device of) the consumable 150 when the smoking substitute device 110 is activated, e.g. via the electrical interface 160 of the consumable 150 (discussed below). When the main body 120 is not physically coupled to the consumable 150, the electrical interface may be configured to receive power from the charging station 6. The electrical interface 136 may also be used to identify the consumable 150 from a list of known consumables. For example, the consumable may be a particular flavour and/or have a certain concentration of nicotine. This can be identified to the control unit 130 of the main body 120 when the consumable is connected to the main body. Additionally, or alternatively, there may be a separate communication interface provided in the main body 120 and a corresponding communication interface in the consumable 150 such that, when connected, the consumable can identify itself to the main body 120.

The additional components 138 of the main body 120 may include the optional light 126 discussed above.

The additional components 138 of the main body 120 may, if the power source 140 is a rechargeable battery, include a charging port configured to receive power from the charging station 6. This may be located at the bottom end 124 of the main body 120. Alternatively, the electrical interface 136 discussed above is configured to act as a charging port configured to receive power from the charging station 6 such that a separate charging port is not required.

The additional components 138 of the main body 120 may, if the power source 140 is a rechargeable battery, include a battery charging control circuit, for controlling the charging of the rechargeable battery. However, a battery charging control circuit could equally be located in the charging station 6 (if present).

The additional components 138 of the main body 120 may include an airflow sensor for detecting airflow in the smoking substitute device 110, e.g. caused by a user inhaling through a mouthpiece 166 (discussed below) of the smoking substitute device 110. The smoking substitute device 110 may be configured to be activated when airflow is detected by the airflow sensor. This optional sensor could alternatively be included in the consumable 150 (though this is less preferred where the consumable 150 is intended to be disposed of after use, as in this example). The airflow sensor can be used to determine, for example, how heavily a user draws on the mouthpiece or how many times a user draws on the mouthpiece in a particular time period.

The additional components 138 of the main body 120 may include an actuator, e.g. a button. The smoking substitute device 110 may be configured to be activated when the actuator is actuated. This provides an alternative to the airflow sensor noted, as a mechanism for activating the smoking substitute device 110.

As shown in FIG. 2(*b*), the consumable 150 includes the tank 156, an electrical interface 160, a heating device 162, one or more air inlets 164, a mouthpiece 166, and, optionally, one or more additional components 168.

The electrical interface 160 of the consumable 150 may include one or more electrical contacts. The electrical interface 136 of the main body 120 and an electrical interface 160 of the consumable 150 are preferably configured to contact each other and therefore electrically couple the main body 120 to the consumable 150 when the main body 120 is physically coupled to the consumable 150. In this way, electrical energy (e.g. in the form of an electrical current) is able to be supplied from the power source 140 in the main body 120 to the heating device 162 in the consumable 150.

The heating device 162 is preferably configured to heat e-liquid contained in the tank 156, e.g. using electrical energy supplied from the power source 140. In one example, the heating device 162 may include a heating filament and a wick, wherein a first portion of the wick extends into the tank 156 in order to draw e-liquid out from the tank 156, and wherein the heating filament coils around a second portion of the wick located outside the tank 156. In this example, the heating filament is configured to heat up e-liquid drawn out of the tank 156 by the wick to produce an aerosol vapour.

The one or more air inlets 164 are preferably configured to allow air to be drawn into the smoking substitute device 110, when a user inhales through the mouthpiece 166.

In use, a user activates the smoking substitute device 110, e.g. through actuating an actuator included in the main body 120 or by inhaling through the mouthpiece 166 as described above. Upon activation, the control unit 130 may supply electrical energy from the power source 140 to the heating device 162 (via electrical interfaces 136, 166), which may cause the heating device 162 to heat e-liquid drawn from the tank 156 to produce a vapour which is inhaled by a user through the mouthpiece 166.

As an example of one of the one or more additional components 168, an interface for obtaining an identifier of the consumable may be provided. As discussed above, this interface may be, for example, an RFID reader, a barcode or QR code reader, or an electronic interface which is able to identify the consumable to the main body. The consumable may, therefore include any one or more of an RFID chip, a barcode or QR code, or memory within which is an identifier and which can be interrogated via the electronic interface in the main body.

Figure 3:
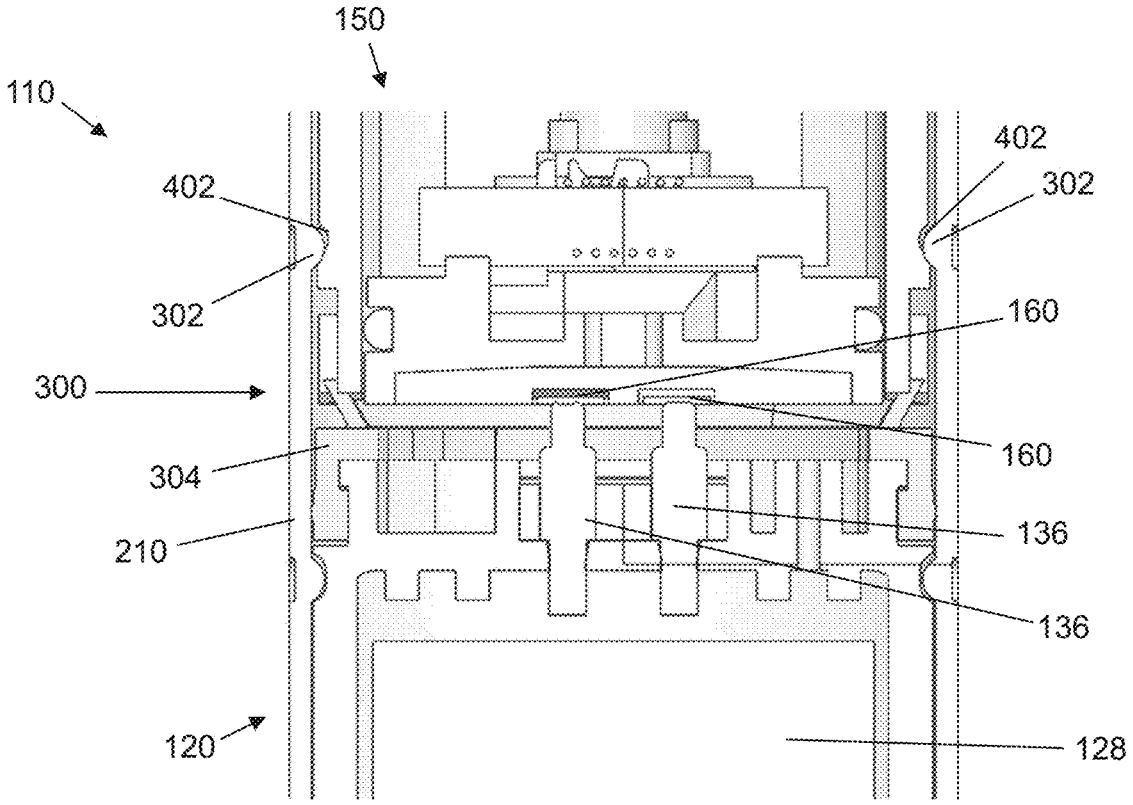
FIG. 3 is a cross-sectional view of a smoking substitute device including a consumable.

Of course, a skilled reader would readily appreciate that the smoking substitute device 110 shown in FIGS. 2 and 3 shows just one example implementation of a smoking substitute device, and that other forms of smoking substitute device could be used.

By way of example, a HNB smoking substitute device including a main body and a consumable could be used, instead of the smoking substitute device 110. One such HNB smoking substitute device is the IQOS® smoking substitute device discussed above.

As another example, an open system vaping device which includes a main body, a refillable tank, and a mouthpiece could be used, instead of the smoking substitute device 110. One such open system vaping device is the blu PROT™ e-cigarette discussed above.

As another example, an entirely disposable (one use) smoking substitute device could be used as the smoking substitute device.

FIG. 3 shows a cross-sectional view of a smoking substitute device 110 including the seal according to an embodiment of the present invention. Broadly, the device comprises a main body or housing 120 which has a casing 210, the main body including a connector 300 for releasably retaining, and electrically connecting to, a consumable 150. Electrical connectors 136 of the connector 300 connect with respective contacts 160 in the consumable, thereby allowing power from a battery 128 in the main body to be transferred to a heater in the consumable. Physical connectors 302 of the connector 300 interact with corresponding fixtures 402 of the consumable 150. In this example, the physical connectors 302 are one or more protrusions which grip counterpart grooves 402 in the consumable.

Between the consumable 150 and the main body or housing 120 is a flexible seal 304 which is within the connector 300. The flexible seal in this example is situated between a lowermost surface of the consumable 150, and a surface of the main housing which includes one or more electrical connectors 136. As will be appreciated, the consumable is introduced into connector by pushing it into a top end of the main housing, as has been discussed previously.

Therefore, when inserted, the lowermost surface of the consumable compresses the flexible seal in a direction towards the battery 128.

Figure 4:
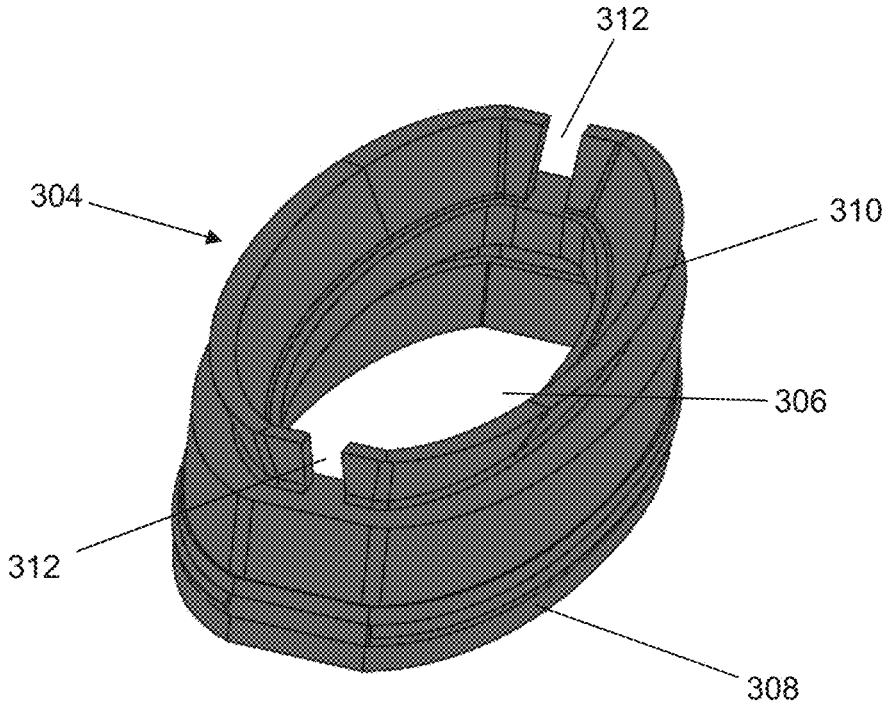
FIG. 4 is an isometric view of a flexible seal.

FIG. 4 shows the flexible seal 304 in more detail. As can be seen, the flexible seal broadly comprises a generally planar base portion 308 having an ovoid cross section in plan view, a protruding portion 310, an aperture 306 and one or more airway slots 312. When installed in a smoking substitute device, the generally planar base portion of the flexible seal is adjacent to the surface of the main body containing the electrical connectors 136. The protruding portion 310 protrudes in a direction generally away from the electrical connectors 136. In this example, the protruding portion forms a lip seal. Thus, when the consumable 150 is introduced to the main body, a lowermost surface thereof compresses the protruding portion. The protruding portion in this example extends from the generally planar base portion at an angle, so as to provide a lip. The protruding portion may have a width which is narrower than the generally planar base portion. This can be seen most clearly in FIG. 3, where the generally planar base portion extends further than the protruding portion.

Advantageously, such a flexible seal can help ensure that the effect of any minor variations in the manufacture of either the consumable 150 or the main body 120 are negated. Notably, the air flow rate through the device, which is defined at least in part by the spatial separation of the consumable and main body when installed, may be rendered more constant through implementation of the flexible seal.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

LIST OF FEATURES

110 Smoking substitute device
120 Main body
122 Top end of main body
124 Bottom end of main body
126 Light
128 Slot
130 Control unit
132 Memory
134 Wireless interface
136 Electrical interface
138 Additional component
140 Power source
150 Consumable
152 Top end of consumable
154 Bottom end of consumable
156 Tank
158 Window
160 Electrical interface
162 Heating device
164 Air inlets
166 Mouthpiece
168 Additional components
210 Casing of main body
300 Connector
302 Physical connector in main body
304 Flexible seal
306 Aperture in flexible seal
308 Planar base portion
310 Protruding portion
312 Airway slots
402 Groove

The invention claimed is:

1. A smoking substitute device, comprising:

a battery; and a connector, usable to connect a consumable to the battery;

wherein the connector includes one or more electrical connectors, for connecting a heater in the consumable to the battery, and one or more physical connectors configured to releasably retain the consumable;

wherein the connector further comprises a flexible seal, disposed between the battery and the consumable when the consumable is retained by the connector and wherein the flexible seal includes one or more airway slots, such that when a consumable is retained by the connector an airflow path is provided from an air inlet of the device through the one or more airway slots and into the consumable; and wherein the flexible seal comprises a generally planar base portion positioned adjacent to the battery, and a protruding portion which protrudes from the planar base portion and which is adjacent to the consumable when the consumable is retained by the connector, wherein the protruding portion protrudes from the planar base portion at an oblique angle, thereby providing a lip seal.

2. The smoking substitute device of claim 1, wherein the battery is provided within a main housing of the device, and the connector is provided at one end thereof.

3. The smoking substitute device of claim 1, wherein the battery is provided within a main housing of the device, and the connector is formed by one end thereof.

4. The smoking substitute device of claim 1, wherein the flexible seal includes an aperture through which electrical connectors of the consumable are connectable with the electrical connectors of the connector when the consumable is retained by the connector.

5. The smoking substitute device of claim 1, wherein the flexible seal forms a seal with a lower surface of the consumable when the consumable is retained by the connector, said lower surface including one or more air inlets for the consumable.

6. The smoking substitute device of claim 1, wherein the protruding portion is configured to be compressed towards the planar base portion when the consumable is retained by the connector.

7. The smoking substitute device of claim 1, wherein the one or more airway slots are provided within the protruding portion of the flexible seal.

8. The smoking substitute device of claim 1, wherein the protruding portion has a maximum width, as measured from one point to an opposing point, which is less than a maximum width of the planar base portion.

9. A smoking substitute device, comprising:

a battery; and a connector, usable to connect a consumable to the battery; wherein the connector includes one or more electrical connectors, for connecting a heater in the consumable to the battery, and one or more physical connectors configured to releasably retain the consumable;

wherein the connector further comprises a flexible seal, disposed between the battery and the consumable when the consumable is retained by the connector, and wherein the flexible seal comprises a generally planar base portion positioned adjacent to the battery, and a protruding portion which protrudes from the planar base portion and which is adjacent to the consumable when the consumable is retained by the connector;

wherein the protruding portion protrudes from the planar base portion at an oblique angle, thereby providing a lip seal.

10. The smoking substitute device of claim 9, wherein the battery is provided within a main housing of the device, and the connector is provided at one end thereof.

11. The smoking substitute device of claim 9, wherein the battery is provided within a main housing of the device, and the connector is formed by one end thereof.

12. The smoking substitute device of claim 9, wherein the flexible seal includes an aperture through which electrical connectors of the consumable are connectable with the electrical connectors of the connector when the consumable is retained by the connector.

13. The smoking substitute device of claim 9, wherein the flexible seal forms a seal with a lower surface of the consumable when the consumable is retained by the connector, said lower surface including one or more air inlets for the consumable.

14. The smoking substitute device of claim 9, wherein the protruding portion is configured to be compressed towards the planar base portion when the consumable is retained by the connector.

15. The smoking substitute device of claim 9, wherein the protruding portion has a maximum width, as measured from one point to an opposing point, which is less than a maximum width of the planar base portion.

* * * * *